US009270043B2

(12) United States Patent
Kobayashi et al.

(10) Patent No.: US 9,270,043 B2
(45) Date of Patent: Feb. 23, 2016

(54) CONNECTOR

(71) Applicant: NHK Spring Co., Ltd., Yokohama-shi (JP)

(72) Inventors: Takao Kobayashi, Kanagawa (JP); Michiya Masuda, Kanagawa (JP)

(73) Assignee: NHK Spring Co., Ltd., Yokohama-shi (JP)

( * ) Notice: Subject to any disclaimer, the term of this patent is extended or adjusted under 35 U.S.C. 154(b) by 0 days.

(21) Appl. No.: 14/385,209

(22) PCT Filed: Mar. 14, 2013

(86) PCT No.: PCT/JP2013/057277
§ 371 (c)(1),
(2) Date: Sep. 15, 2014

(87) PCT Pub. No.: WO2013/137415
PCT Pub. Date: Sep. 19, 2013

(65) Prior Publication Data

US 2015/0056875 A1 Feb. 26, 2015

(30) Foreign Application Priority Data

Mar. 16, 2012 (JP) ..... 2012-061168

(51) Int. Cl.
*H01R 13/115* (2006.01)
*H01R 13/02* (2006.01)
(Continued)

(52) U.S. Cl.
CPC ..... *H01R 13/02* (2013.01); *H01R 13/04* (2013.01); *H01R 13/28* (2013.01); *H01R 4/188* (2013.01); *H01R 13/115* (2013.01)

(58) Field of Classification Search
CPC ... H01R 13/115; H01R 13/113; H01R 13/187
See application file for complete search history.

(56) References Cited

U.S. PATENT DOCUMENTS 2,336,385 A * 12/1943 Batcheller ..... H01R 13/115 403/329
2,735,998 A * 2/1956 Martines ..... H01R 13/115 439/849

(Continued)

FOREIGN PATENT DOCUMENTS

CN 201126879 Y 10/2008
JP 58-062572 A 4/1983

(Continued)

OTHER PUBLICATIONS

International Search Report dated Jun. 11, 2013, issued for PCT/JP2013/057277.

(Continued)

*Primary Examiner* — Gary Paumen
(74) *Attorney, Agent, or Firm* — Locke Lord LLP

(57) ABSTRACT

A connector includes: a first terminal that is electrically conductive and includes a first contact portion being plate shaped and including a first teeth portion with one of surfaces thereof forming a plurality of continuous concavo-convex shapes, and a first base portion joined to the first contact portion and connected to one of connection targets; and a second terminal that is electrically conductive and includes a second contact portion including a second teeth portion with one of surfaces thereof forming a plurality of continuous concavo-convex shapes, the second teeth portion being engageable with the first teeth portion, and a second base portion that is joined to the second contact portion and connected to the other one of the connection targets, wherein the first terminal and the second terminal are electrically connected to each other by engagement between the first teeth portion and the second teeth portion.

11 Claims, 15 Drawing Sheets

(51) Int. Cl.

| | |
|---|---|
| ***H01R 13/04*** | (2006.01) |
| ***H01R 13/28*** | (2006.01) |
| *H01R 4/18* | (2006.01) |

(56) References Cited

U.S. PATENT DOCUMENTS

| | | | | |
|---|---|---|---|---|
| 4,764,133 | A | 8/1988 | Kaneko | |
| 4,778,231 | A * | 10/1988 | Seidler | H01R 13/193 439/295 |
| 5,281,178 | A * | 1/1994 | Biscorner | H01R 13/052 439/845 |
| 5,649,837 | A * | 7/1997 | Arnold | H01R 13/743 439/247 |
| 6,068,526 | A * | 5/2000 | Nottrott | H01R 13/18 439/845 |
| 6,293,831 | B1 * | 9/2001 | Yamatani | H01R 13/115 439/849 |
| 2003/0060090 | A1 * | 3/2003 | Allgood | H01R 11/289 439/845 |

FOREIGN PATENT DOCUMENTS

| | | | |
|---|---|---|---|
| JP | 62-135374 | U | 8/1987 |
| JP | 04-174989 | A | 6/1992 |
| JP | 06-033371 | A | 4/1994 |
| JP | 2003-142213 | A | 5/2003 |
| JP | 2005-332658 | A | 12/2005 |
| JP | 2007-179986 | A | 7/2007 |

OTHER PUBLICATIONS

Office Action dated Dec. 11, 2015, issued for the Chinese patent application No. 201380014340.3 and English translation thereof.

* cited by examiner

CONNECTOR

FIELD

The present invention relates to a connector that is interposed between two connection targets and achieves electric continuity between the two connection targets.

BACKGROUND

Conventionally, a connector which electrically connects between electronic devices by being interposed between two connection targets and causing electric continuity to be achieved between the two connection targets is used in order to connect the electronic devices arranged inside an automobile or the like. This connector causes two terminals respectively connected to the connection targets to come into contact with each other to electrically connect between the connection targets.

The connector needs to keep connecting between the electronic devices in an electrically stable state. As a connector for realizing stable electric continuity, for example, a connector has been disclosed, in which a contact portion provided inside a female terminal forming a rectangular-column-shaped hollow space is, along with insertion therein of a male terminal having a groove portion formed along an insertion and extraction direction thereof, guided to the groove portion forming a sloped surface or a spherical surface (for example, see Patent Literature 1).

Further, as a connector for realizing more stable electric continuity by dissipating heat generated by electric conduction, for example, a connector has been disclosed, in which a spring portion is provided inside a female terminal forming a rectangular-column-shaped hollow space, and when a male terminal having a cross section that is approximately C-shaped in a direction orthogonal to an insertion and extraction direction is inserted into the hollow space of the female terminal, the spring portion achieves connection by pressing a side surface of the male terminal thereon (for example, see Patent Literature 2). In this connector, a convex portion extending in the insertion and extraction direction is provided on an inner surface of the female terminal facing the male terminal, and electric continuity is obtained by contact between a side surface of the male terminal and the convex portion of the female terminal.

CITATION LIST

Patent Literature

Patent Literature 1: Japanese Laid-open Patent Publication No. 2005-332658

Patent Literature 2: Japanese Laid-open Patent Publication No. 2007-179986

SUMMARY

Technical Problem

For a connector mounted on an automobile or the like, electric continuity needs to be achieved stably even if a large electric current flows therethrough. In addition, downsizing of connectors themselves have been desired recently. If the conventional connector disclosed in Patent Literature 1 or 2 is downsized for that, a contact area between the terminals is decreased and a resistance value thereof is increased, and thus if a large electric current is flowed therethrough, there is a risk that heat generation may be caused by electric conduction.

Further, although the connector described in Patent Literature 1 is able to deal with displacement of an insertion position of the male terminal, by the groove portion being shaped with the sloped surface or spherical surface, the groove portion must be made large according to an expected amount of the displacement and thus the connector is not suitable for downsizing. Furthermore, the contact between the male terminal and the female terminal is of point or line contact and thus an area of the contact is small and the connector is not suitable for reduction in the resistance value and for stabilization.

The present invention has been made in view of the above, and an object thereof is to provide a connector that is able to suppress increase in resistance value and heat generation due to electric conduction and that is downsizable.

Solution to Problem

To solve the above-described problem and achieve the object, a connector according to the present invention is interposed between two connection targets and achieves electric continuity between the two connection targets and includes: a first terminal that is electrically conductive and includes a first contact portion being plate shaped and having including a first teeth portion with one of surfaces thereof forming a plurality of continuous concavo-convex shapes, and a first base portion joined to the first contact portion and connected to one of the connection targets; and a second terminal that is electrically conductive and includes a second contact portion having including a second teeth portion with one of surfaces thereof forming a plurality of continuous concavo-convex shapes, the second teeth portion being engageable with the first teeth portion, and a second base portion that is joined to the second contact portion and connected to the other one of the connection targets, wherein the first terminal and the second terminal are electrically connected to each other by engagement between the first teeth portion and the second teeth portion.

Moreover, in the above described connector according to the present invention, an angle formed by side surfaces joined to a tooth tip of the first teeth portion is the same as an angle formed by side surfaces joined to a tooth bottom of the second teeth portion.

Moreover, in the above described connector according to the present invention, the maximum distance between side surfaces joined to a tooth tip of the first teeth portion is the same as the maximum distance between side surfaces joined to a tooth bottom of the second teeth portion.

Moreover, in the above described connector according to the present invention, shapes of the first and second contact portions are curved, and pitch lines of the first and second teeth portions are each arc shaped.

Moreover, in the above described connector according to the present invention, shapes of pitch lines of the first and second teeth portions are different from each other in a non-engagement state thereof.

Moreover, in the above described connector according to the present invention, shapes of pitch lines of the first and second teeth portions are the same in a non-engagement state thereof.

Moreover, the above described connector according to the present invention further includes: a curved portion that respectively extends in bent-back directions from width-direction end portions of the first contact portion and that has a surface at a distal end side thereof, the surface being curved to be opposite to the first contact portion; and a first member that biases the curved portion and the second contact portion in directions away from each other in a state in which the second contact portion has been inserted in an inner space formed by the first contact portion and the curved portion.

Moreover, the above described connector according to the present invention includes a holding portion that extends in a bent-back direction from a width direction end portion of the first contact portion, that has a surface at a distal end side thereof, the surface being curved to be opposite to the first contact portion, and that covers and holds the second contact portion in a state in which the first contact portion and the second contact portion are laid over each other.

Moreover, the above described connector according to the present invention further includes a second member that is wound around the second and first contact portions and biases the first and second contact portions in directions approaching each other, in a state in which the first and second contact portions are laid over each other.

Moreover, in the above described connector according to the present invention, a radius of an individual tooth tip of the first teeth portion is different from a radius of an individual tooth bottom of the second teeth portion.

Moreover, in the above described connector according to the present invention, the radius of the individual tooth tip of the first teeth portion is larger than the radius of the individual tooth bottom of the second teeth portion.

Advantageous Effects of Invention

According to the present invention, since contact surfaces of respective terminals are caused to engage and contact with each other by teeth portions forming concavo-convex shapes that are engageable with each other, effects of being able to ensure a large surface area upon the contact, to reduce a contact resistance value even if a twisted force (unbalanced load) acts on the respective terminals by the engagement between a plurality of individual teeth, and thus to be downsizable while suppressing increase in resistance value and heat generation due to electric conduction, are achieved.

DESCRIPTION OF EMBODIMENTS

Hereinafter, modes for carrying out the present invention will be described in detail with the drawings. The present invention is not limited by the following embodiments. Further, each drawing referred to in the following description schematically illustrates shapes, sizes, and positional relations merely to an extent that allows contents of the present invention to be understood. That is, the present invention is not limited only to the shapes, sizes, and positional relations exemplified in each drawing.

First Embodiment

Figure 1:
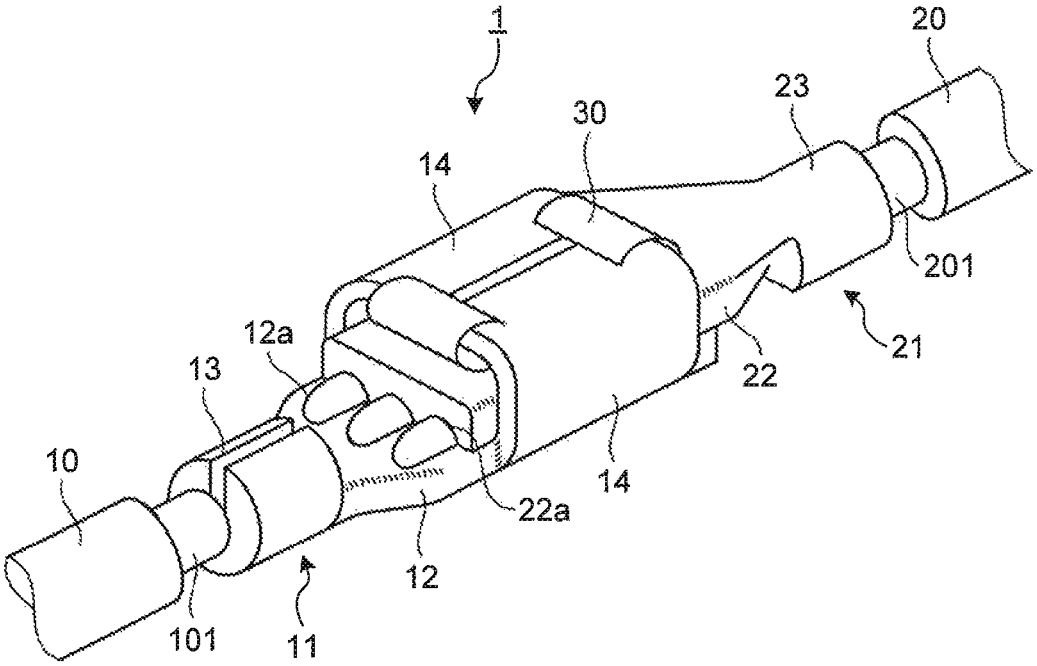
FIG. 1 is a perspective diagram schematically illustrating a configuration of a connector according to a first embodiment of the present invention.
Figure 2:
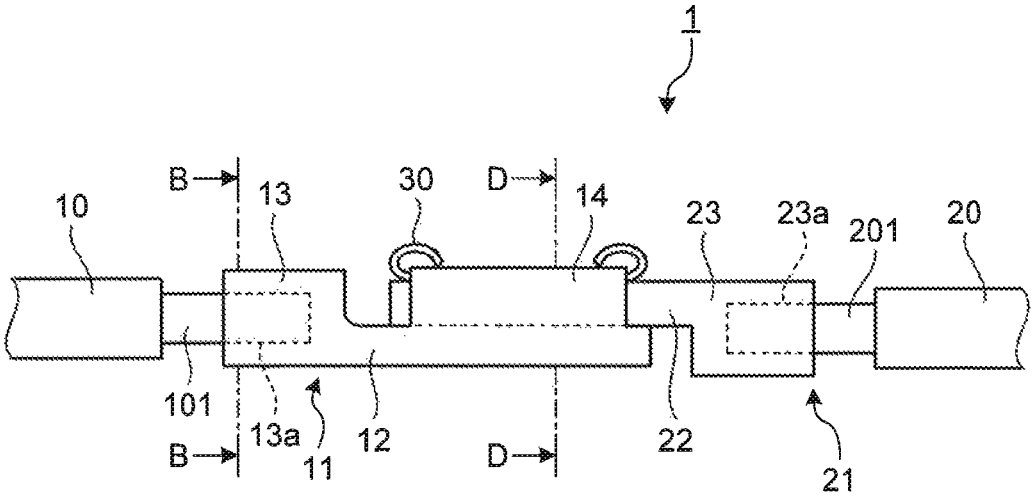
FIG. 2 is a side view schematically illustrating a configuration of the connector according to the first embodiment of the present invention.

FIG. 1 is a perspective diagram schematically illustrating a configuration of a connector 1 according to a first embodiment. FIG. 2 is a side view schematically illustrating the configuration of the connector 1 according to the first embodiment. The connector 1 illustrated in FIGS. 1 and 2 is interposed between two connection targets and achieves electric continuity between the two connection targets by contact between terminals respectively coupled to the connection targets.

The connector 1 includes: a terminal 11, as a first terminal, extending approximately in a plate shape, being coupled to a conductor 10 that is one of the connection targets, and having electric conductivity; a terminal 21, as a second terminal, extending approximately in a plate shape, being coupled to a conductor 20 that is the other one of the connection targets, and having electric conductivity; and a fixing member 30 (first member), which covers a part of the terminal 21 and fixes between the terminals 11 and 21. In the conductor 10 and the conductor 20, a plurality of electric power lines (electric power line groups 101 and 201) are covered by an insulative resin or the like.

Figure 3:
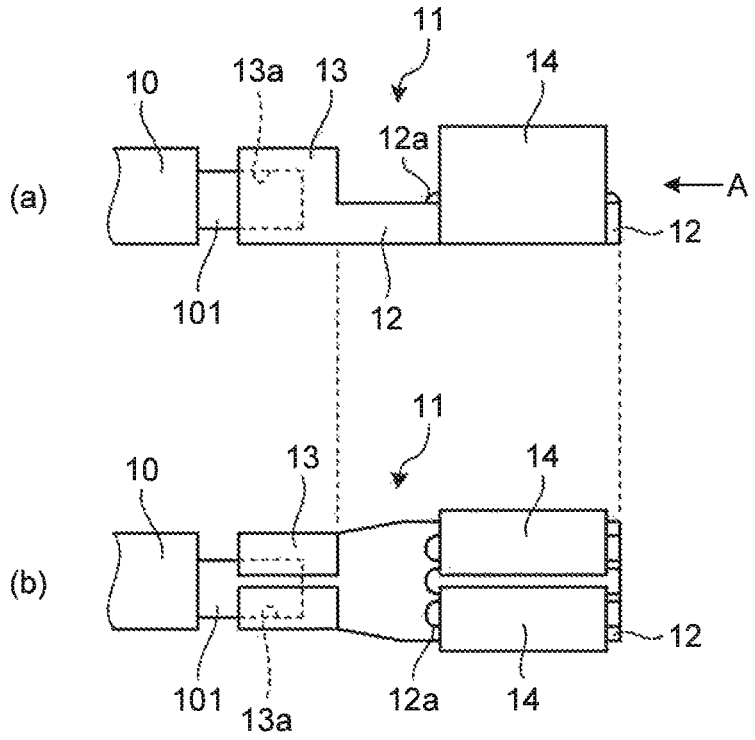
FIG. 3 is a side view and a top view schematically illustrating a configuration of a terminal of the connector according to the first embodiment of the present invention.
Figure 4:
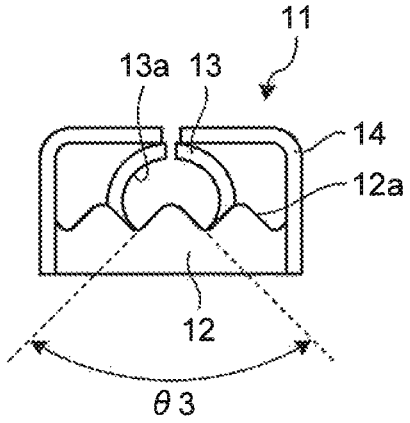
FIG. 4 is a diagram illustrating the configuration of the terminal viewed from an arrow-A direction illustrated in FIG. 3.

FIG. 3 is a side view (a) and a top view (b) schematically illustrating a configuration of the terminal 11 according to the first embodiment. FIG. 4 is a diagram illustrating the configuration of the terminal 11 viewed from an arrow-A direction illustrated in FIG. 3. The terminal 11 is formed of an electrically conductive material that is approximately plate shaped. The terminal 11 includes: a contact portion 12 (first contact portion) that contacts the terminal 21; a base portion 13 (first base portion) that is coupled to one of end portions of the contact portion 12, the end portions being in a direction orthogonal to a width direction and a plate thickness direction of the contact portion 12; and a curved portion 14 that respectively extends from lateral sides (end portions) in the width direction of the contact portion 12 to a direction perpendicular to a plate face of the contact portion 12 and that bends such that end portion sides thereof are opposite to this plate face.

The contact portion 12 has a teeth portion 12*a* (first teeth portion) with one of surfaces thereof formed in a plurality of continuous concavo-convex shapes, and with a concave shape and a convex shape repeated and continuous in the width direction on this surface in a side view viewed from a direction orthogonal to the width direction (see FIG. 4).

The base portion 13 has an accommodating portion 13*a*, which forms an approximately column shaped hollow space that is along a direction in which the terminal 11 extends by both ends thereof being curved, and which accommodates the electric power line group 101 of the conductor 10 in the hollow space. A diameter of this hollow space in a direction perpendicular to the direction in which the terminal 11 extends is, like in a cross section diagram illustrated in FIG. 5, equivalent to or greater than the maximum diameter d1 of the group 101 of the plurality of electric power lines bundled together. By accommodating the electric power line group 101 in the hollow space of the accommodating portion 13*a*, the terminal 11 and the conductor 10 are able to be electrically coupled to each other. In this case, by applying crimp (plastic deformation or the like) from an outer peripheral side of the base portion 13, a wall surface of the accommodating portion 13*a* is pressed against the electric power line group 101 to fix the electric power line group 101 and the accommodating portion 13*a*.

Figure 6:
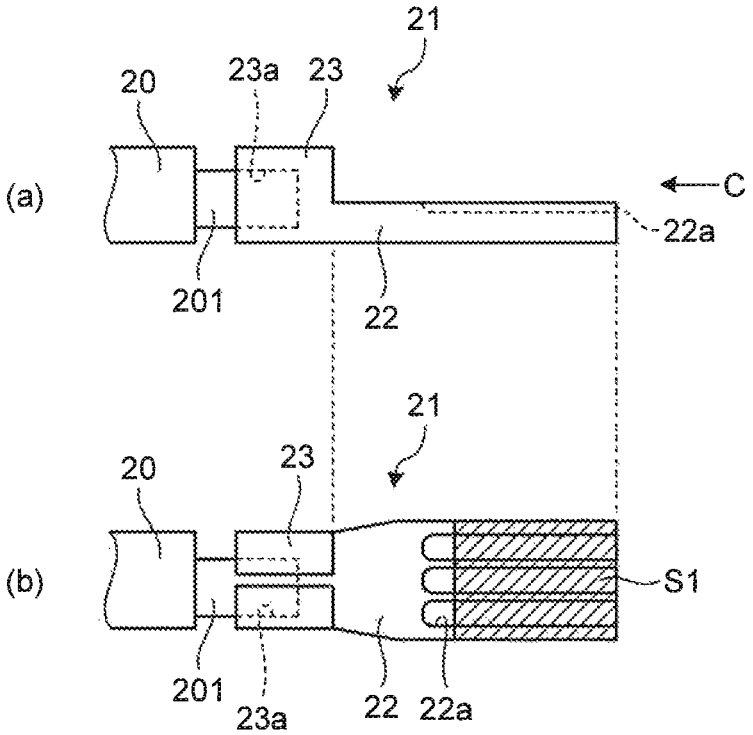
FIG. 6 is a side view and a top view schematically illustrating a configuration of a terminal of the connector according to the first embodiment of the present invention.
Figure 7:
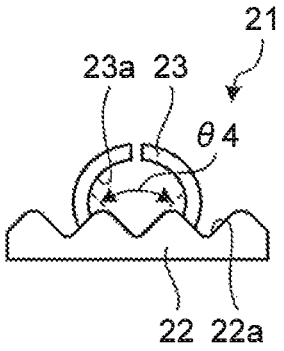
FIG. 7 is a diagram illustrating the configuration of the terminal viewed from an arrow-C direction illustrated in FIG. 6.

FIG. 6 is a side view (a) and a top view (b) schematically illustrating a configuration of the terminal 21 according to the first embodiment. FIG. 7 is a diagram illustrating the configuration of the terminal 21 viewed from an arrow-C direction illustrated in FIG. 6. The terminal 21 includes: a contact portion 22 (second contact portion) that contacts the terminal 11 and is approximately plate shaped; and a base portion 23 (second base portion) that is coupled to one of end portions of the contact portion 22, the end portions being in a direction orthogonal to a width direction and a plate thickness direction of the contact portion 22, and that is connected to the conductor 20.

The contact portion 22 includes a teeth portion 22*a* (second teeth portion) with one of surfaces thereof formed in a plurality of continuous concavo-convex shapes, and with a concave shape and a convex shape repeated and continuous in the width direction on this surface in a side view viewed from a direction orthogonal to the width direction (see FIG. 7). The concavo-convex shapes of the teeth portion 22*a* are in a form opposite to the concavo-convex shapes of the teeth portion 12*a* according to the teeth portion 12*a*, and engagement is possible by fitting these concavo-convex shapes to each other upon contact between surfaces where the teeth portions 12*a* and 22*a* of the contact portions 12 and 22 are formed.

The base portion 23 includes an accommodating portion 23*a*, which forms an approximately column shaped hollow space that is along a direction in which the terminal 21 extends by both ends thereof being curved, and which accommodates the electric power line group 201 of the conductor 20 in the hollow space. A diameter of this hollow space in a direction perpendicular to the direction in which the terminal 21 extends is equivalent to or greater than the maximum diameter of the electric power line group 201. By accommodating the electric power line group 201 in the hollow space of the accommodating portion 23*a*, the terminal 21 and the conductor 20 are able to be electrically coupled to each other. By applying crimp (plastic deformation or the like) from an outer peripheral side of the base portion 23, a wall surface of the accommodating portion 23*a* is pressed against the electric power line group 201 to fix the electric power line group 201 and the accommodating portion 23*a*.

As the electrically conductive material of the terminals 11 and 21, a pure copper based material is used. The terminals 11 and 21 are manufactured by forming through pressing or heading of plate shaped members that are formed of pure copper, the plate shaped members having plate thicknesses approximately equal to those of the contact portions 12 and 22, such that the contact portions 12 and 22 are formed into predetermined shapes. In the first embodiment, they are described as being plate shaped, but their plate faces may be curved shaped.

Figure 5:
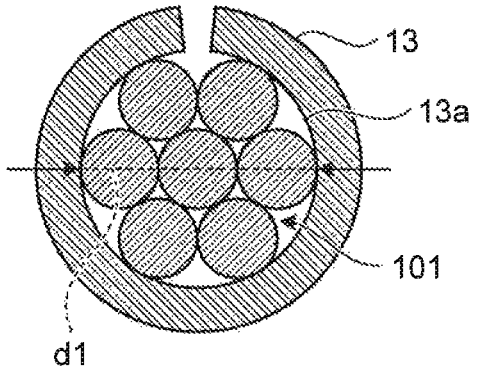
FIG. 5 is a cross section diagram illustrating a B-B line cross section of the terminals illustrated in FIG. 2.

For a contact surface between the terminals 11 and 21 in the connector 1, where a surface area of a contact area S1 illustrated in FIG. 6 is Sa and a cross section area of the electric power line group 101 in the cross section illustrated in FIG. 5 is Sb (the sum of respective cross section areas of the plurality of electric power lines), a relation between the surface area Sa of the contact area S1 and the cross section area Sb of the electric power line group 101 may be expressed as Sa≥Sb. By this relation, contact resistance between the terminals 11 and 21 is able to be reduced, and stable and efficient electric continuity is able to be obtained.

Further, where a cross section area of a cross section of the contact portion 12 in the plate thickness direction is Sc and this cross section area Sc is about the same as the above mentioned cross section area Sb of the electric power line group 101, resistance value upon electric conduction between the terminals 11 and 21 is able to be reduced.

Figure 8:
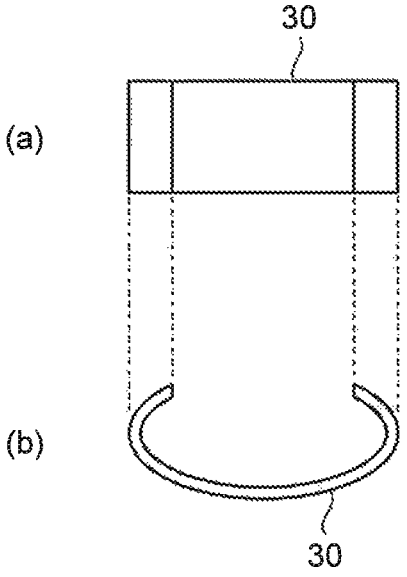
FIG. 8 is a top view and a side view schematically illustrating a configuration of a fixing member of the connector according to the first embodiment of the present invention.

FIG. 8 is a top view (a) and a side view (b) schematically illustrating a configuration of the fixing member 30 according to the first embodiment. For the fixing member 30, carbon tool steel or stainless steel, which is plate shaped, is used, and the fixing member 30 is curved to form an approximately oval shape when side-viewed. The fixing member 30 is, as illustrated in FIGS. 1 and 2, arranged to cover both ends of the curved portion 14 at end portion sides of the curved portion 14, the both ends being in a direction orthogonal to the direction in which the curved portion 14 extends.

Further, in a state in which the contact portion 22 has been inserted in an inner space formed by the contact portion 12 and the curved portion 14 and in which the teeth portion 12*a* and the teeth portion 22*a* of the contact portions 12 and 22 have been engaged and laid over with each other (in a state in which the respective width directions of the contact portions 12 and 22 are parallel to each other), the fixing member 30 extends in a direction perpendicular to these width directions, is wound around the curved portion 14, is positioned between the curved portion 14 and a surface of the contact portion 22, the surface being opposite to a side on which the teeth portion 22*a* is arranged, and biases the curved portion 14 and the contact portion 22 in directions away from each other to fix therebetween. Any elastic body that is at least able to bias the curved portion 14 and the contact portion 22 in directions away from each other and fix therebetween is applicable as the fixing member.

Figure 9:
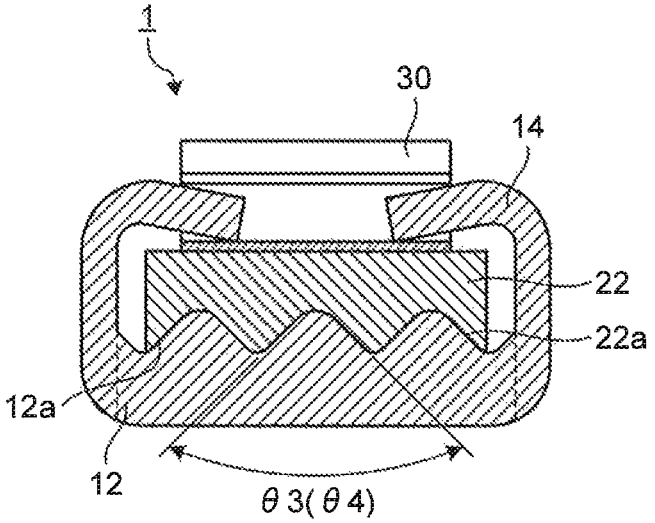
FIG. 9 is a cross section diagram illustrating a D-D line cross section of the connector illustrated in FIG. 2.
Figure 10:
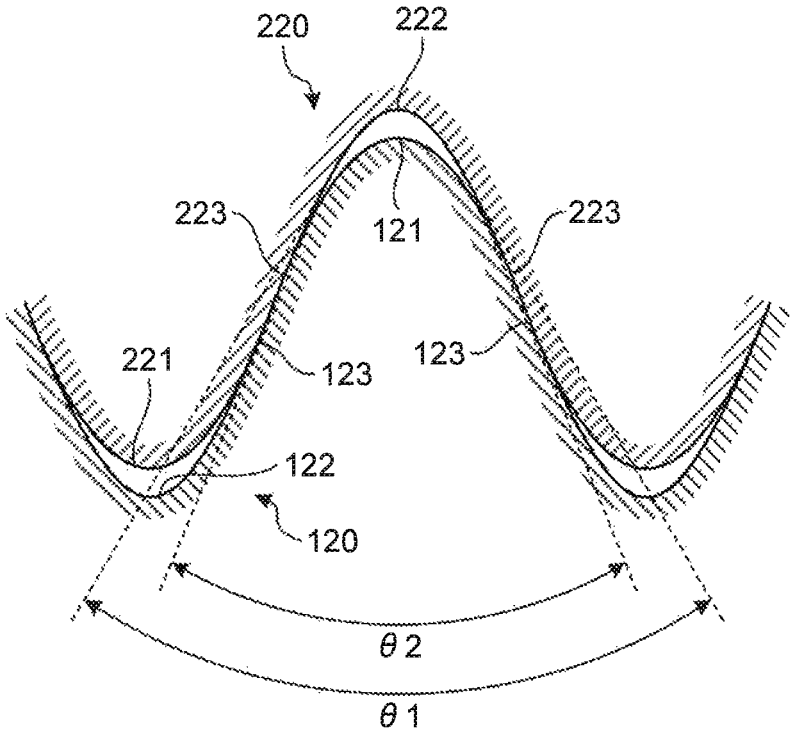
FIG. 10 is a schematic diagram illustrating a configuration of a teeth portion of the connector according to the first embodiment of the present invention.

The connector 1 electrically connects, as illustrated in FIGS. 1, 2, and 9, between the terminal 11 and the terminal 21 by engaging and overlaying the teeth portion 12*a* and teeth portion 22*a* of the contact portions 12 and 22 with each other. In this case, in the terminals 11 and 21, the teeth portion 12*a* and the teeth portion 22*a* are in contact with each other. In the teeth portion 12*a* and teeth portion 22*a*, as illustrated in FIG. 10, when adjacent concave shape and convex shape are defined as a pair of individual tooth 120 and tooth 220, each individual tooth 120 or 220 has a tooth tip 121 or 221 forming a tip end of the convex shape, a tooth bottom 122 or 222 forming a bottom portion of the concave shape, and a sloped portion 123 or 223 linearly coupling the tooth tip 121 or 221 with the tooth bottom 122 or 222 respectively. An angle θ1 formed by the tooth tip 121 and an angle θ2 formed by the tooth bottom 222 are preferably different from each other and a relation of θ1>θ2 preferably holds therebetween.

Further, where an angle formed by side surfaces (sloped portions 123) joined to the tooth tip 121 of the individual tooth 120 is θ3, and an angle formed by side surfaces (sloped portions 223) joined to the tooth bottom 222 of the individual tooth 220 is θ4 (see FIGS. 4, 7, and 9), these angles θ3 and θ4 preferably satisfy a relation of θ3=θ4. By the above relations among the angles θ1 to θ4, in the individual tooth 120 and individual tooth 220, the tooth tip 121 and the tooth bottom 222 do not come into contact with each other and the sloped portion 123 and sloped portion 223 come into surface contact with each other. By advancing the tooth tip 121 into the tooth bottom 222, the sloped portions 123 and 223 are able to be fastened tightly and an even secure contact state is able to be realized. Further, since the curved portion 14 holds the contact portion 22 of the terminal 21 between the curved portion 14 and the contact portion 12 and the fixing member 30 applies load on the contact portion 22 in a direction towards the contact portion 12, the contact state is able to be retained.

Although the above angles θ3 and θ4 have been described as satisfying θ3=θ4, the angles θ3 and θ4 may be different from each other. In that case, the angle of the tooth tip (θ3) is preferably larger than the angle of the tooth bottom (θ4).

Figure 11:
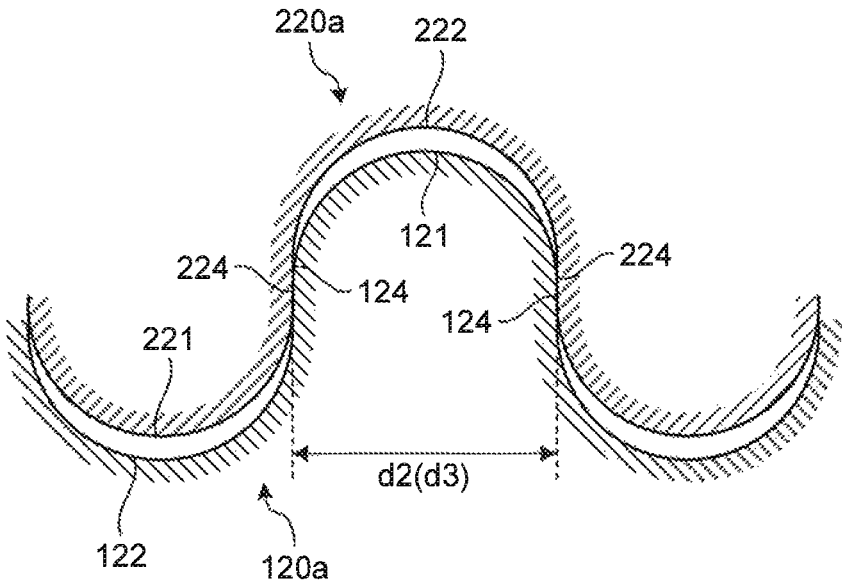
FIG. 11 is a schematic diagram illustrating a configuration of another example of the teeth portion of the connector according to the first embodiment of the present invention.

Further, similar things apply to individual tooth 120*a* and tooth 220*a* as illustrated in FIG. 11, which have curved surface portions 124 and 224 respectively coupling the tooth tips 121 and 221 with the tooth bottoms 122 and 222 in a curved line manner. Where the maximum distance between side surfaces (curved surface portions 124) joined to the tooth tip 121 of the individual tooth 120*a* is d2 and the maximum distance between side surfaces (curved surface portions 224) joined to the tooth bottom 222 of the individual tooth 220*a* is d3, a relation of d2=d3 holds. Although the above maximum distances d2 and d3 have been described as satisfying the relation d2=d3, as long as engagement is possible, the maximum distances d2 and d3 may be different from each other. In that case, the maximum distance d2 is preferably larger than the maximum distance d3. The above described shapes of the teeth are examples, and any combined shapes other than these may be used.

Figure 12:
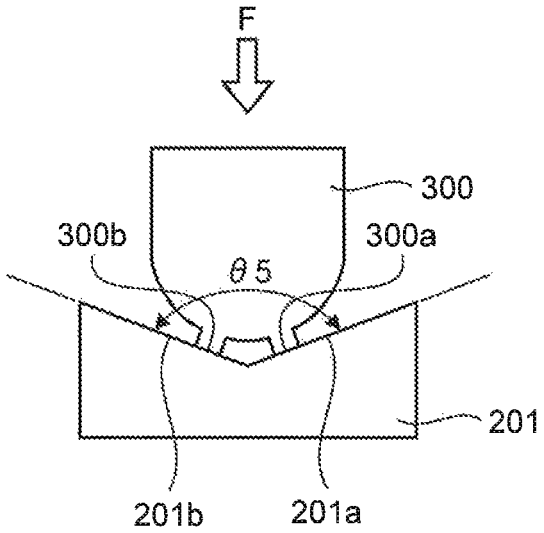
FIG. 12 is a schematic diagram illustrating an outline of a contact resistance comparative test.
Figure 13:
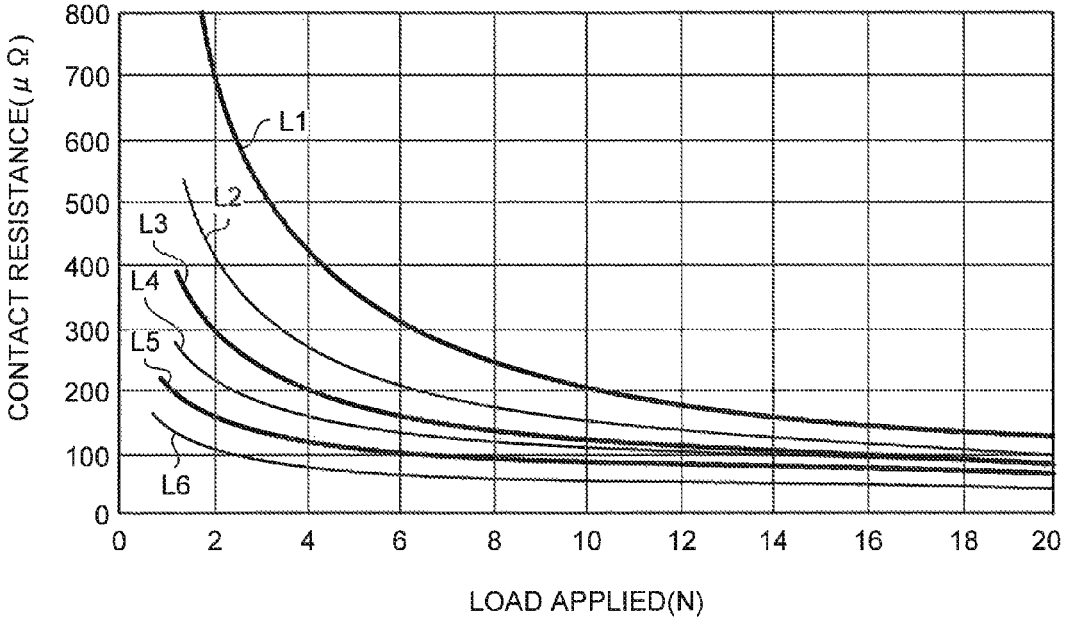
FIG. 13 is a graph illustrating contact resistance versus load applied in the contact resistance comparative test.

FIG. 12 is a schematic diagram illustrating an outline of a contact resistance comparative test. FIG. 13 is a graph illustrating contact resistance (μQ) versus load applied (N) in the contact resistance comparative test. In the contact resistance comparative test, as illustrated in FIG. 12, test pieces 201 and 300 are used to measure contact resistance between the test pieces. The test piece 300 has convex portions 300*a* and 300*b* that contact sloped portions 201*a* and 201*b* of the test piece 201. Further, as the sloped portions 201*a* and 201*b*, those with a slope angle θ5 formed by the sloped portions 201*a* and 201*b* satisfying θ5=180°, 160°, 140°, 100°, 60°, and 45° were used. In the contact resistance comparative test, at each slope angle θ5, contact resistance between the test pieces 201 and 300 versus load applied F was found. Contact areas between the convex portions 300*a* and 300*b* and the sloped portions 201*a* and 201*b* were constant (of the same contact areas) regardless of the respective slope angles θ5.

In FIG. 13, contact resistance versus load applied is illustrated by a curve L1 for θ5=180°, a curve L2 for θ5=160°, a curve L3 for θ5=140°, a curve L4 for θ5=100°, a curve L5 for θ5=60°, and a curve L6 for θ5=45°. When the load applied F is constant, the smaller the value of the slope angle θ5 is, the lower the contact resistance between the test pieces is.

From the above relation between the slope angle and contact resistance, for the teeth portions according to the first embodiment, by respectively decreasing the angles (θ3 and θ4) formed by the respective sloped portions corresponding to the above angle θ5, the contact resistance is able to be reduced further. Further, by decreasing the angles (θ3 and θ4) formed by the respective sloped portions, the number of individual teeth in the same individual teeth forming area is able to be increased, and thus the surface area Sa of the contact area S1 is increased.

In order to retain the contact state between the teeth portions 12*a* and 22*a* as described above, for example, a radius of an R-shape of the tooth tip 121 of each individual tooth 120 of the teeth portion 12*a* (hereinafter, referred to as R1) and a radius of an R-shape of the tooth bottom 222 of each individual tooth 220 of the teeth portion 22*a* (hereinafter, referred to as R2) preferably satisfy a relation of R1>R2 similarly to the above described angles θ1 and θ2. Due to variation in manufacture, R1 and R2 may be different from those as designed. In that case, as measures to retain the contact state between the teeth portions 12*a* and 22*a*, by manufacturing them by setting a difference between R1 and R2 to be larger than as designed, the side surface (sloped portion or curved surface portion) of the individual tooth 120 is able to be securely contacted with the side surface (sloped portion or curved surface portion) of the individual tooth 220 when the teeth portion 12*a* contacts the teeth portion 22*a*. Further, by setting a radius (R3) of an R-shape of the tooth bottom 122 of the individual tooth 120 of the teeth portion 12*a* and a radius (R4) of an R-shape of the tooth tip 221 of the individual tooth 220 of each teeth portion 22*a* as described above for manufacture, the above described effects are able to be obtained. When, for example, R1<R2, there is a risk that the contact area may be decreased by the tooth tip 121 and the tooth bottom 222 coming into contact with each other before the contact between the sloped portions is completed, or by a non-contacting portion being generated between the side surface of the teeth portion 12*a* and the side surface of the teeth portion 22*a*. When a radius of an R-shape of the tooth bottom 122 of the teeth portion 12*a* is R1, and a radius of an R-shape of the tooth tip 221 of the teeth portion 22*a* is R2, the above described relation is inverted and designing to satisfy R1<R2 is performed. Further, in this first embodiment, the radii of the tooth tip and tooth bottom refer to curvature radii of the tooth tip and tooth bottom at their vertices.

According to the above described first embodiment, since the contact surfaces of the respective terminals are caused to come into contact with each other at the portions having the approximately same curvature radii or at the portions having the corresponding angles, by the teeth portions forming the concavo-convex shapes engageable with each other, the surface area upon the contact is able to be increased, and the contact resistance value is able to be reduced even if a twisted force (unbalanced load) acts on each terminal by the engagement between the plurality of individual teeth, and thus downsizing becomes possible while suppressing increase in resistance value and heat generation due to electric conduction.

Further, according to this first embodiment, since the contact portion 22 of the terminal 21 is held in the inner space formed by the contact portion 12 and the curved portion 14 by the curved portion 14 provided in the terminal 11, and the fixing member 30 applies the load in a direction towards the contact portion 12 on the contact portion 22, a contact state that is even more secure is able to be retained. In this case, since the contact portions 12 and 22 where the plurality of concavo-convex shapes are repeated in the width direction are engaged with each other, the contact state is able to be retained even more securely against the load applied from outside. The curved portion 14 is able to retain the contact state between the terminals by suppressing rotation of the terminals against the load applied to the respective terminals in directions in which the contact portions in the contact state separate from each other.

Figure 14:
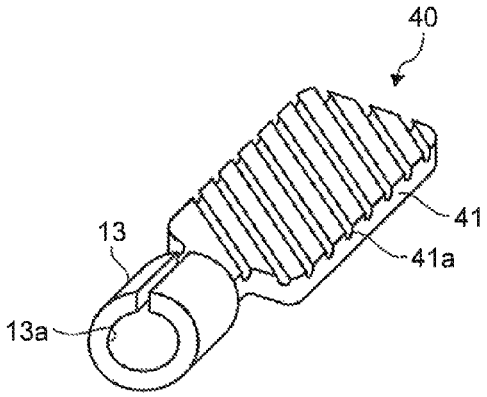
FIG. 14 is a perspective diagram schematically illustrating a configuration of a terminal of a connector according to a modified example 1-1 of the first embodiment of the present invention.
Figure 15:
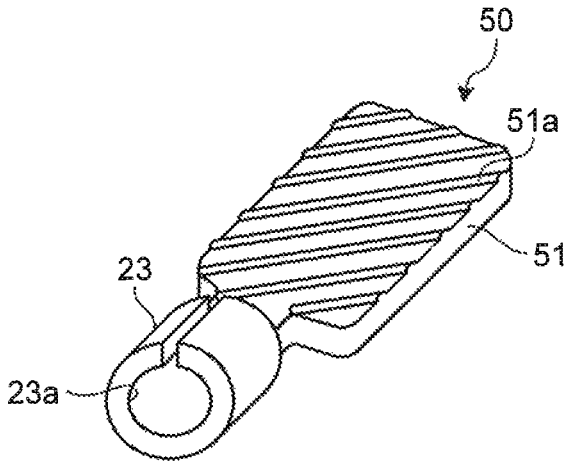
FIG. 15 is a perspective diagram schematically illustrating a configuration of a terminal of the connector according to the modified example 1-1 of the first embodiment of the present invention.

FIG. 14 is a perspective diagram schematically illustrating a configuration of a terminal 40 of a connector according to a modified example 1-1 of the first embodiment. FIG. 15 is a perspective diagram schematically illustrating a configuration of a terminal 50 of the connector according to the modified example 1-1 of the first embodiment. To structural elements that are the same as those of the connector described above with FIG. 1 and the like, the same signs will be appended. Like the terminals 40 and 50 illustrated in FIGS. 14 and 15, if fittable to each other, with a contact portion 41 (first contact portion) having a first teeth portion on one of surfaces thereof, the first teeth portion being formed with concave portions 41*a* extending and slanted with respect to a direction in which the terminal 40 extends, a contact portion 51 (second contact portion) having a second teeth portion on one of surfaces thereof, the second teeth portion being formed with convex portions 51*a* that are able to be accommodated in inner spaces formed by these concave portions, may be caused to come in contact.

Figure 16:
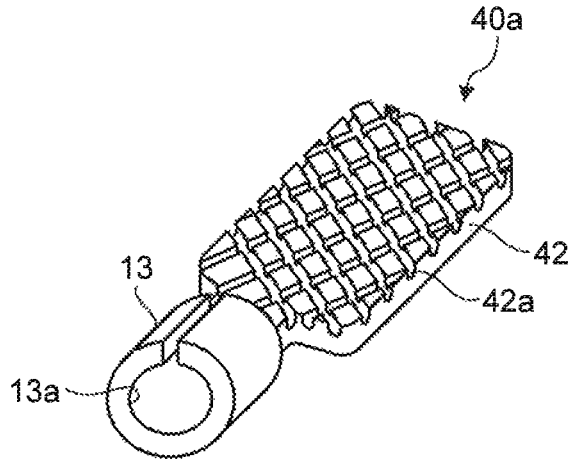
FIG. 16 is a perspective diagram schematically illustrating a configuration of a terminal of a connector according to a modified example 1-2 of the first embodiment of the present invention.
Figure 17:
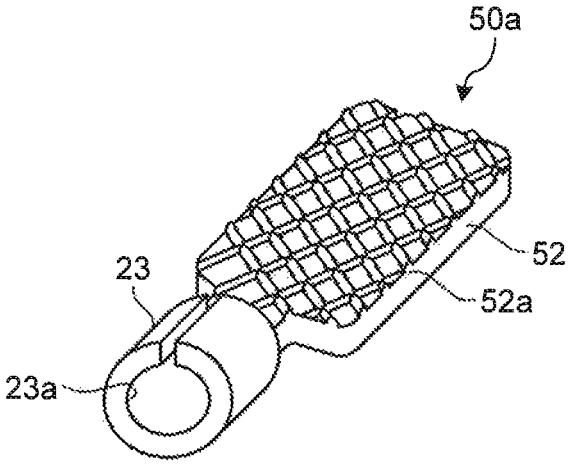
FIG. 17 is a perspective diagram schematically illustrating a configuration of a terminal of the connector according to the modified example 1-2 of the first embodiment of the present invention.

FIG. 16 is a perspective diagram schematically illustrating a configuration of a terminal 40*a* of a connector according to a modified example 1-2 of the first embodiment. FIG. 17 is a perspective diagram schematically illustrating a configuration of a terminal 50*a* of the connector according to the modified example 1-2 of the first embodiment. To structural elements that are the same as those of the connector described above with FIG. 1 and the like, the same signs will be appended. Like the terminals 40*a* and 50*a* illustrated in FIGS. 16 and 17, if fittable to each other, with a contact portion 42 (first contact portion) having a first teeth portion on one of surfaces thereof, the first teeth portion being formed with concave portions 42*a* extending in a latticed pattern, a contact portion 52 (second contact portion) having a second teeth portion on one of surfaces thereof, the second teeth portion being formed with convex portions 52*a* that are able to be accommodated in inner spaces formed by these concave portions, may be caused to come in contact.

Second Embodiment

Figure 18:
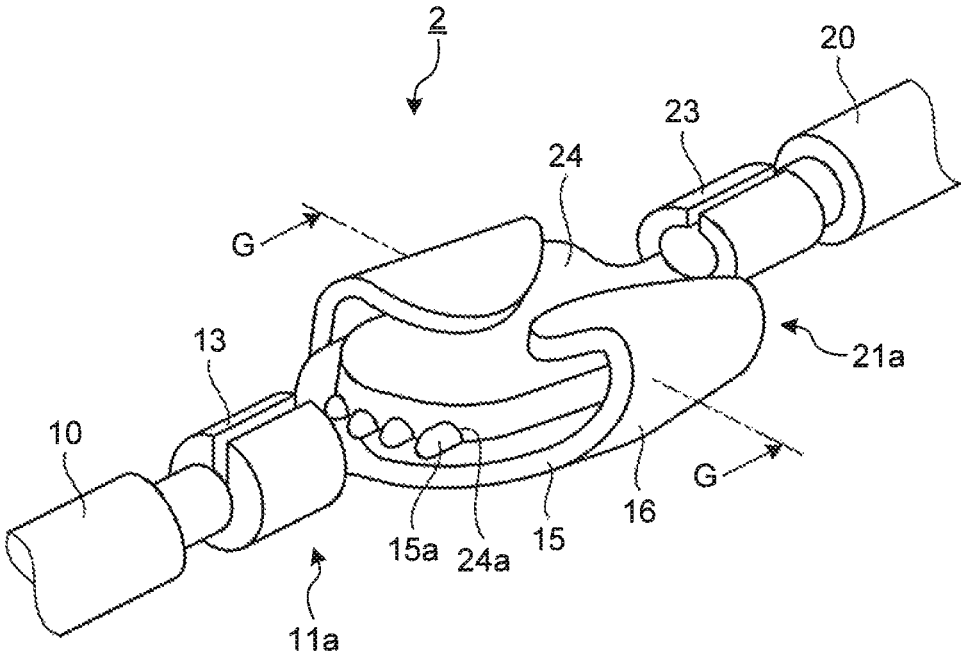
FIG. 18 is a perspective diagram schematically illustrating a configuration of a connector according to a second embodiment of the present invention.

Next, a second embodiment of the present invention will be described with reference to FIG. 18. FIG. 18 is a perspective diagram schematically illustrating a configuration of a connector 2 according to the second embodiment. The connector 2 illustrated in FIG. 18 achieves electric continuity between connection targets by contact and coupling between terminals respectively coupled to the connection targets. To structural elements that are the same as those of the connector described above with FIG. 1 and the like, the same signs will be appended.

The connector 2 has a terminal 11*a* as a first terminal that extends in an approximately plate shape, is coupled to the conductor 10, which is one of the connection targets, and has electric conductivity, and a terminal 21*a* as a second terminal that extends in an approximately plate shape, is coupled to the other one of the connection targets, and has electric conductivity. The connector 2 obtains electric continuity by contacting the terminal 11*a* and the terminal 21*a* with each other.

Figure 19:
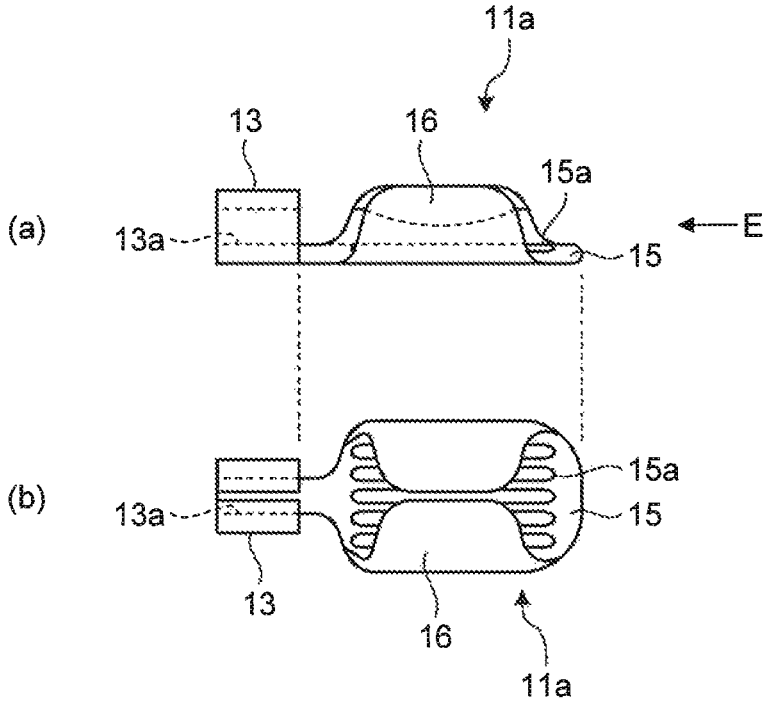
FIG. 19 is a side view and a top view schematically illustrating a configuration of a terminal of the connector according to the second embodiment of the present invention.
Figure 20:
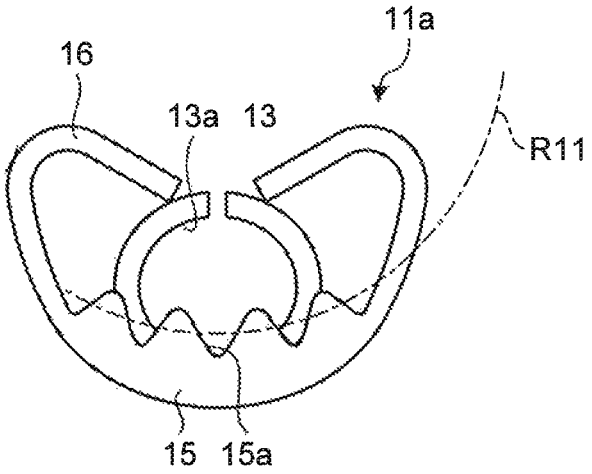
FIG. 20 is a diagram illustrating the configuration of the terminal viewed from an arrow-E direction illustrated in FIG. 19.

FIG. 19 is a side view (a) and a top view (b) schematically illustrating a configuration of the terminal 11*a* according to this second embodiment. FIG. 20 is a diagram illustrating the configuration of the terminal 11*a* viewed from an arrow-E direction illustrated in FIG. 19. The terminal 11*a* is formed of an electrically conductive material that is approximately plate shaped. The terminal 11*a* includes: a contact portion 15 (first contact portion) that contacts the terminal 21*a* and that is approximately plate shaped; the base portion 13 that is coupled to one of end portions of the contact portion 15, the end portions being in a direction orthogonal to a width direction and a plate thickness direction of the contact portion 15, and that is connected to the conductor 10; and a holding portion 16 that respectively extends from lateral sides (end portions) in the width direction of the contact portion 15 to a direction perpendicular to a plate face of the contact portion 15, that is curved such that end portion sides thereof are opposite to this plate face, and that covers and holds a contact portion 24 in a state in which the contact portion 15 and a later described contact portion 24 are engaged with and laid over each other.

The contact portion 15 has a teeth portion 15*a* (first teeth portion) with one of surfaces thereof shaped in a concavo-convex shape, and with a concave shape and a convex shape repeated and continuous in the width direction on this surface in a side view viewed from a direction orthogonal to the width direction (see FIG. 20).

Figure 21:
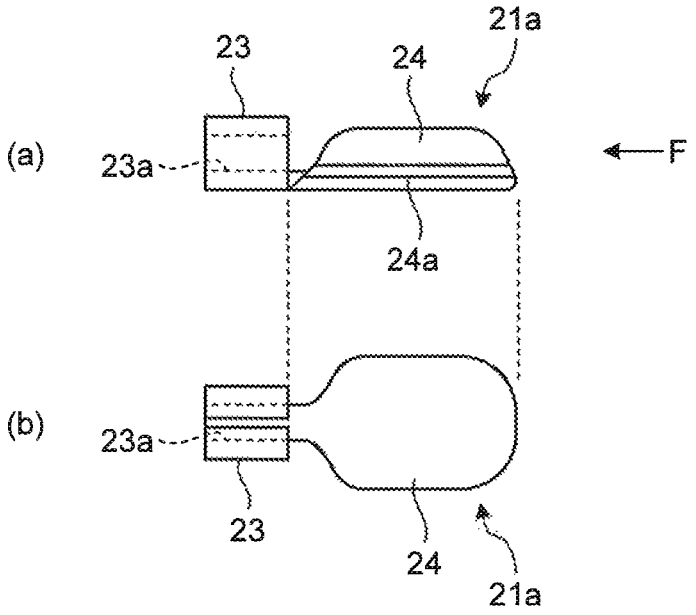
FIG. 21 is a side view and a top view schematically illustrating a configuration of a terminal of the connector according to the second embodiment of the present invention.
Figure 22:
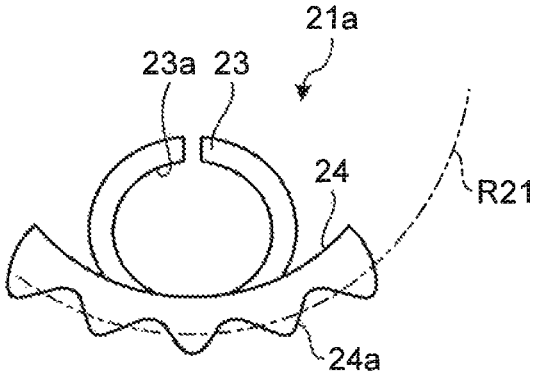
FIG. 22 is a diagram illustrating the configuration of the terminal viewed from an arrow-F direction illustrated in FIG. 21.

FIG. 21 is a side view (a) and a top view (b) schematically illustrating a configuration of the terminal 21*a* according to this second embodiment. FIG. 22 is a diagram illustrating the configuration of the terminal 21*a* viewed from an arrow-F direction illustrated in FIG. 21. The terminal 21*a* includes: a contact portion 24 (second contact portion) that contacts the terminal 11*a* and is approximately plate shaped; and a base portion 23 (second base portion) that is coupled to one of end portions of the contact portion 24, the end portions being in a direction orthogonal to a width direction and a plate thickness direction of the contact portion 24, and that is connected to the conductor 20.

The contact portion 24 has a teeth portion 24*a* (second teeth portion) with one of surfaces thereof shaped in a concavo-convex shape, and with a concave shape and a convex shape repeated and continuous in the width direction on this surface in a side view viewed from a direction orthogonal to the width direction (see FIG. 22). The concavo-convex shape of the contact portion 24 is in a form opposite to the concavo-convex shape of the contact portion 15 and concavo-convex surfaces thereof are able to be fitted to each other when surfaces of the contact portions 15 and 24 forming the concavo-convex shapes are contacted with each other.

In the contact portion 15, as illustrated in FIG. 20, a plate face thereof forms a curved shape in a side view viewed from a longitudinal direction thereof (arrow E direction). That is, a pitch line passing the centers of slopes (or curved surfaces) joining adjacent tooth tips and tooth bottoms in the teeth portion 15*a* is arc shaped (arc R11). Further, in the contact portion 24, as illustrated in FIG. 22, a plate face thereof forms a curved shape in a side view viewed from a longitudinal direction thereof (arrow F direction). That is, a pitch line passing the centers of slopes (or curved surfaces) joining adjacent tooth tips and tooth bottoms in the teeth portion 24*a* is arc shaped (arc R21). When the contact portions face each other, the contact portion 15 and the contact portion 24 are curved in the same direction (in a direction where the curved direction becomes opposite with respect to a contact surface therebetween). Shapes of the arc R11 and arc R21 (curvature radii) may be the same or different in a non-engagement state. In particular, if the shapes are different from each other, when the contact portion 15 and the contact portion 24 contact each other, the teeth portions 15*a* and 24*a* are in close contact with each other by diameter expansion and diameter reduction therebetween, and thus a contact state therebetween is able to be retained even more securely. If the arc R11 and arc R21 are completely round, the curvature radii of the arc R11 and arc R21 are equivalent or different from each other.

Similarly to the first embodiment, as an electrically conductive material for the terminals 11*a* and 21*a*, a pure copper based material is used. The terminals 11*a* and 21*a* are manufactured by forming through pressing or heading of plate shaped pure copper based members having plate thicknesses approximately equal to those of the contact portions 15 and 24 such that the contact portions 15 and 24 are formed into predetermined shapes. The teeth portion 15*a* and the teeth portion 24*a* are formed such that their curvature radii are equal to each other.

Figure 23:
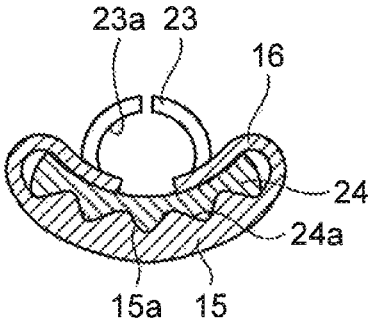
FIG. 23 is a cross section diagram illustrating a G-G line cross section of the connector illustrated in FIG. 18.

As illustrated in FIGS. 18, 19, and 23, the connector 2 electrically connects between the terminal 11*a* and the terminal 21*a* by engaging and laying over the contact portions 15 and 24 with each other. In this case, in the terminals 11*a* and 21*a*, the teeth portion 15*a* and the teeth portion 24*a* are in contact with each other. Since curvature radii of respective outer edges of the teeth portion 15*a* and the teeth portion 24*a* are equal to each other, the teeth portion 15*a* and the teeth portion 24*a* are in surface contact with each other. The contact portion 24 of the terminal 21*a* contacts the contact portion 15. Further, the holding portion 16 holds the contact portion 24 of the terminal 21*a* by sandwiching the contact portion 24 between the holding portion 16 and the contact portion 15, and thus is able to retain the contact state.

According to the above described second embodiment, since the contact surfaces of the respective terminals are caused to contact each other at the portions having the approximately same curvature radii by the teeth portions that are engageable with each other and that are concavo-convex shaped, the surface area upon the contact is able to be increased and the contact resistance value is able to be decreased even if a twisted force (unbalanced load) acts on the respective terminals by the engagement between the plurality of individual teeth, and thus downsizing becomes possible while suppressing increase in resistance value and heat generation due to electric conduction.

Further, according to this second embodiment, since the holding portion 16 holds the contact portions 15 and 24, without using a fixing member like that of the first embodiment, the contact state between the terminals 11*a* and 21*a* is able to be retained.

Furthermore, according to this second embodiment, since the contact portions 15 and 24 are in a curved shape along the plate faces thereof and contact each other with respect to this curved shape, strength of close contact between the teeth portions 15*a* and 24*a* is able to be increased and the contact state therebetween is able to be retained even more securely.

The above described pitch lines are applicable to the first embodiment also, and that in which a pitch line of each teeth portion is in a straight line shape, and that in which a pitch line of one of teeth portions is straight line shaped and a pitch line of the other one of the teeth portions is arc shaped in their non-engagement state are also included.

Figure 24:
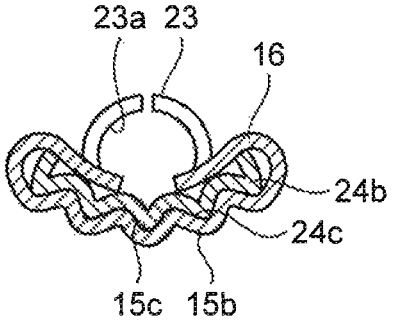
FIG. 24 is a diagram illustrating a configuration of a terminal of a connector according to a modified example 2-1 of the second embodiment of the present invention and is a cross section diagram corresponding to the G-G line cross section of the connector illustrated in FIG. 18.

FIG. 24 is a diagram illustrating a configuration of a terminal of a connector according to a modified example 2-1 of this second embodiment and is a cross section corresponding to a G-G line cross section of the connector illustrated in FIG. 18. Like contact portions 15*b* and 24*b* illustrated in FIG. 24, correspondingly with teeth portions 15*c* and 24*c* that are concavo-convex shaped with a concave shape and a convex shape repeated and continuous in a width direction on that surface in a side view (cross section) viewed from a direction orthogonal to a width direction thereof, reverse sides of the teeth portions 15*c* and 24*c* may be concavo-convex shaped. Since plate thicknesses of the contact portions 15*b* and 24*b* are approximately even, the contact portions 15*b* and 24*b* are able to be formed by performing bending on plate shaped members and thus yield in manufacture is able to be improved and manufacture is able to be done even more easily. Further, by making the plate thicknesses approximately even, spring performance of the contact portions themselves are able to be improved more than the above described contact portions 15 and 24, strength of close contact between the teeth portions 15*c* and 24*c* is able to be increased, and the contact state is able to be retained even more securely.

Third Embodiment

Figure 25:
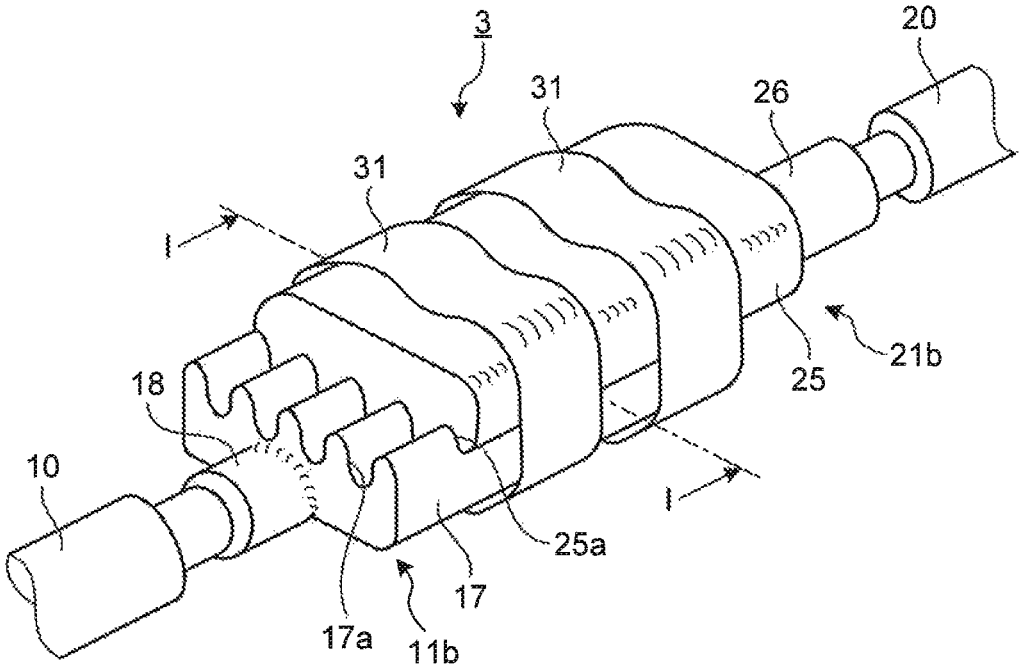
FIG. 25 is a perspective diagram schematically illustrating a configuration of a connector according to a third embodiment of the present invention.

Next, a third embodiment of the present invention will be described with reference to FIG. 25. FIG. 25 is a perspective diagram schematically illustrating a configuration of a connector 3 according to the third embodiment. The connector 3 illustrated in FIG. 25 enables electric continuity between two connection targets by contact and coupling between terminals respectively coupled to the connection targets. To structural elements that are the same as those of the connector described above with FIG. 1 and the like, the same signs will be appended.

The connector 3 includes: a terminal 11*b* as a first terminal extending approximately in a plate shape, being coupled to the conductor 10 that is one of the connection targets, and having electric conductivity; a terminal 21*b* as a second terminal extending approximately in a plate shape, being coupled to the conductor 20 that is the other one of the connection targets, and having electric conductivity; and a plurality of fixing members 31 (a second member), which cover and fix a part of the terminal 11*b* and terminal 21*b* in a state in which a later described contact portion 17 and contact portion 25 are engaged and laid over with each other. Further, the terminal 11*b* and terminal 21*b* are formed in the same shape.

Figure 26:
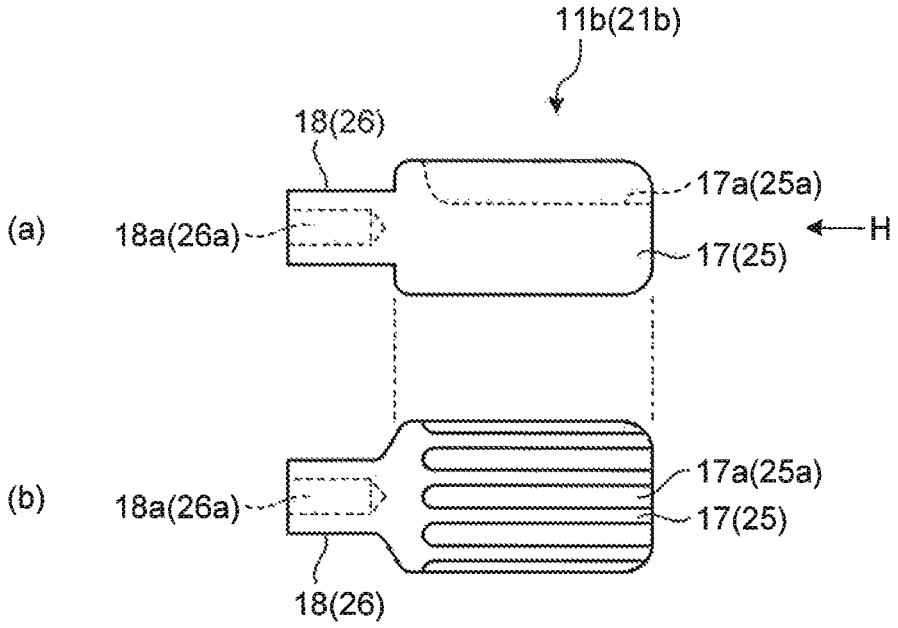
FIG. 26 is a side view schematically illustrating a configuration of a terminal of the connector according to the third embodiment of the present invention.
Figure 27:
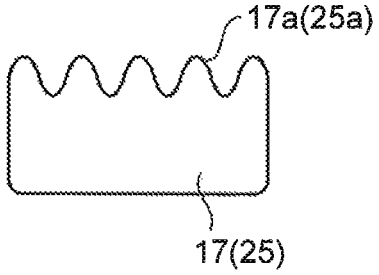
FIG. 27 is a diagram illustrating the configuration of the terminal viewed from an arrow-H direction illustrated in FIG. 26.

FIG. 26 is a side view (a) and a top view (b) schematically illustrating a configuration of the terminal 11*b* according to this third embodiment. FIG. 27 is a diagram illustrating the configuration of the terminal 11*b* viewed from an arrow-H direction illustrated in FIG. 26. The terminal 11*b* is formed of an electrically conductive material that is approximately plate shaped. The terminal 11*b* includes: a contact portion 17 (first contact portion) that contacts the terminal 21*a* and is plate shaped; and a base portion 18 (first base portion) that is coupled to one of end portions of the contact portion 17, the end portions being in a direction orthogonal to a width direction and a plate thickness direction of the contact portion 17, and that is connected to the conductor 10.

The contact portion 17 has a teeth portion 17*a* (first teeth portion) with one of surfaces thereof being concavo-convex shaped, and with a concave shape and a convex shape repeated and continuous in the width direction on this surface in a side view viewed from a direction orthogonal to the width direction (see FIG. 27).

The base portion 18 has an accommodating hole 18*a* that forms an approximately column shaped hollow space along a direction in which the terminal 11*b* extends. A diameter of this hollow space in a direction perpendicular to the direction in which the terminal 11*b* extends is equivalent to or greater than the maximum diameter d1 (see FIG. 5) of the electric power line group 101. By accommodating the electric power line group 101 in the hollow space of the accommodating hole 18*a*, the terminal 11*b* and the conductor 10 are able to be electrically coupled to each other. By applying crimp (plastic deformation or the like) from an outer peripheral side of the base portion 18, a wall surface of the accommodating hole 18*a* is pressed against the electric power line group 101 to fix the electric power line group 101 and the accommodating hole 18*a*.

The terminal 21*b* is formed of an electrically conductive material that is approximately plate shaped. The terminal 21*b* includes: a contact portion 25 (second contact portion) that contacts the terminal 11*b*; and a base portion 26 (second base portion) that is coupled to one of end portions of the contact portion 25, the end portions being in a direction orthogonal to a width direction and a plate thickness direction of the contact portion 25, and that is connected to the conductor 20 (see FIG. 25). The contact portion 25 has a teeth portion 25*a* (second teeth portion) with one of surfaces thereof being concavo-convex shaped, and with a concave shape and a convex shape repeated and continuous in the width direction on this surface in a side view viewed from a direction orthogonal to the width direction (see FIG. 27). Further, the base portion 26 has an accommodating hole 26*a* that forms an approximately column shaped hollow space along a direction in which the terminal 21*b* extends. The concavo-convex shape of the teeth portion 25*a* is of the same shape as the concavo-convex shape of the teeth portion 17*a*, and thus when the surfaces forming the concavo-convex shapes of the teeth portions 17*a* and 25*a* are caused to contact each other, the concavo-convex surfaces thereof are able to be fitted to each other. Tip ends of the respective convex shapes and bottom portions of the concave shapes have the same curvature radii.

For the terminals 11*b* and 21*b*, similarly to the first embodiment, a pure copper based material is used as the electrically conductive material. The terminals 11*b* and 21*b* are manufactured by forming through pressing or heading of plate shaped pure copper based members having plate thicknesses approximately equal to those of the contact portions 17 and 25 such that the contact portions 17 and 25 are formed into predetermined shapes.

Figure 28:
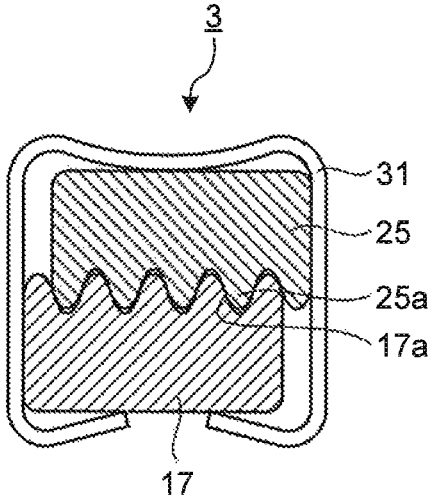
FIG. 28 is a cross section diagram illustrating an I-I line cross section of the connector illustrated in FIG. 25.

The connector 3 electrically connects between the terminal 11*b* and the terminal 21*b* by engaging and laying the teeth portion 17*a* and the teeth portion 25*a* of the contact portions 17 and 25 with and over each other as illustrated in FIGS. 25, 26, and 28. In this case, in the terminals 11*b* and 21*b*, the teeth portion 17*a* and the teeth portion 25*a* are in contact with each other. Since the concavo-convex shapes of the teeth portion 17*a* and the teeth portion 25*a* are the same, in a state in which end faces thereof are displaced from each other, the teeth portions come into surface contact with each other. Further, since the two fixing members 31 are wound around the contact portions 17 and 25 and bias and apply load on the contact portions 17 and 25 in directions in which the contact portions 17 and 25 come close to each other, the contact state therebetween is able to be retained.

According to the above described third embodiment, because the contact surfaces of the respective terminals are caused to come into contact with each other at the portions having approximately the same curvature radii by the teeth portions that are able to be engaged with each other and that are concavo-convex shaped, a surface area upon contact is able to be increased and contact resistance value is able to be reduced even if a twisted force (unbalanced load) acts on the respective terminals by the engagement between the plurality of individual teeth, and thus downsizing as well as suppression of increase in resistance value and of heat generation due to electric conduction become possible.

Furthermore, according to this third embodiment, since the connector is able to be manufactured by using the terminals of the same shape, the terminals do not need to be individually manufactured like in the above described first and second embodiments, and manufacturing steps and manufacturing cost are also able to be reduced. In addition to the straight lined pitch lines of the teeth portion 17*a* and the teeth portion 25*a* like the above described third embodiment, that forming a straight lined shape, and that with a pitch line of one of teeth portions being straight lined and a pitch line of the other being arc shaped are also included.

Figure 29:
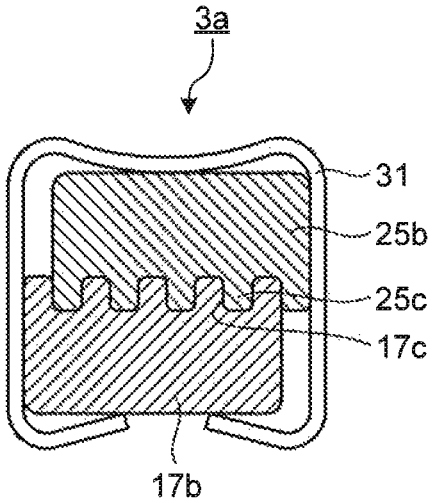
FIG. 29 is a diagram illustrating a configuration of a terminal of a connector according to a modified example 3-1 of the third embodiment of the present invention and is a cross section diagram corresponding to the I-I line cross section of the connector illustrated in FIG. 25.

FIG. 29 is a diagram illustrating a configuration of a connector 3*a* according to a modified example 3-1 of this third embodiment and is a cross section diagram corresponding to the I-I line cross section of the connector illustrated in FIG. 25. Like contact portions 17*b* and 25*b* illustrated in FIG. 29, if engageable with each other, there may be teeth portions 25*c* and 17*c*, that are concavo-convex shaped, that have, in a side view (cross section) viewed from a direction orthogonal to a width direction, a concave shape and a convex shape repeated and continuous in a width direction on a surface thereof, and that have tip ends of a shape that is approximately rectangular.

Figure 30:
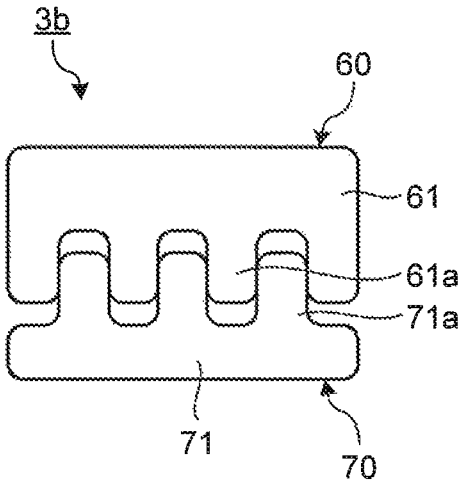
FIG. 30 is a schematic diagram illustrating a configuration of a terminal of a connector according to a modified example 3-2 of the third embodiment of the present invention.

FIG. 30 is a side view schematically illustrating a configuration of terminals 60 and 70 of a connector 3*b* according to a modified example 3-2 of this third embodiment. Like the terminals 60 and 70 illustrated in FIG. 30, when engageable with each other, a contact portion 71 having a teeth portion 71*a* that is formed to be engageable with a teeth portion 61*a* and has tip ends of a shape that is approximately rectangular may be caused to come into contact with a contact portion 61 having the teeth portion 61*a* with tip ends thereof being approximately rectangular shaped. For that, in a side view viewed from a direction orthogonal to a width direction of the contact portions 60 and 70, shapes of the contact portions 60 and 70 are different from each other, and when engaged with each other, an outer edge shape formed by the contact portions 60 and 70 forms an approximately rectangular shape.

By applying the above described relations among the angles formed by the individual teeth and the curvature radii of the R-shapes to the second and third embodiments also, a stable contact state with low contact resistance value is able to be retained.

In the above described first to third embodiments, as long as stable engagement is possible, the sizes of the respective concavo-convex shapes of the teeth portions, and angles and curvature radii of the tooth tips and tooth bottoms may be the same as or different from each other. Further, "the same" means being the same design-wise, and includes errors upon manufacture. Furthermore, the respective configurations according to the first to third embodiments may be combined as appropriate.

INDUSTRIAL APPLICABILITY

As described above, a connector according to the present invention is useful for downsizing while suppressing increase in resistance value and heat generation upon electric conduction.

REFERENCE SIGNS LIST

1, 2, 3, 3*a*, 3*b* Connector
10, 20 Conductor
11, 11*a*, 11*b*, 21, 21*a*, 21*b*, 40, 40*a*, 50, 50*a*, 60, 70 Terminal
12, 15, 15*b*, 17, 17*b*, 22, 24, 24*b*, 25, 25*b*, 41, 42, 51, 52, 61, 71 Contact portion
12*a*, 15*a*, 15*c*, 17*a*, 17*c*, 22*a*, 24*a*, 24*c*, 25*a*, 25*c*, 61*a*, 71*a* Teeth portion
13, 23, 18, 26 Base portion
13*a*, 23*a* Accommodating portion
14 Curved portion
16 Holding portion
18*a*, 26*a* Accommodating hole
30, 31 Fixing member
41*a*, 42*a* Concave portion
51*a*, 52*a* Convex portion
101, 201 Electric power line group
120, 120*a*, 220, 220*a* Individual tooth
121, 221 Tooth tip
122, 222 Tooth bottom
123, 223 Sloped portion
124, 224 Curved surface portion

The invention claimed is:

1. A connector that is interposed between two connection targets and achieves electric continuity between the two connection targets, the connector comprising:

a first terminal that is electrically conductive and includes a first contact portion being plate shaped and including a first teeth portion with one of surfaces thereof forming a plurality of continuous concavo-convex shapes, and a first base portion joined to the first contact portion and connected to one of the connection targets; and a second terminal that is electrically conductive and includes a second contact portion including a second teeth portion with one of surfaces thereof forming a plurality of continuous concavo-convex shapes, the second teeth portion being engageable with the first teeth portion, and a second base portion that is joined to the second contact portion and connected to the other one of the connection targets, wherein the first terminal and the second terminal are electrically connected to each other by engagement between the first teeth portion and the second teeth portion.

2. The connector according to claim 1, wherein an angle formed by side surfaces joined to a tooth tip of the first teeth portion is the same as an angle formed by side surfaces joined to a tooth bottom of the second teeth portion.

3. The connector according to claim 1, wherein the maximum distance between side surfaces joined to a tooth tip of the first teeth portion is the same as the maximum distance between side surfaces joined to a tooth bottom of the second teeth portion.

4. The connector according to claim 1, wherein shapes of the first and second contact portions are curved, and pitch lines of the first and second teeth portions are each arc shaped.

5. The connector according to claim 1, wherein shapes of pitch lines of the first and second teeth portions are different from each other in a non-engagement state thereof.

6. The connector according to claim 1, wherein shapes of pitch lines of the first and second teeth portions are the same in a non-engagement state thereof.

7. The connector according to claim 1, further comprising:

a curved portion that respectively extends in bent-back directions from width-direction end portions of the first contact portion and that has a surface at a distal end side thereof, the surface being curved to be opposite to the first contact portion; and a first member that biases the curved portion and the second contact portion in directions away from each other in a state in which the second contact portion has been inserted in an inner space formed by the first contact portion and the curved portion.

8. The connector according to claim 1, comprising a holding portion that extends in a bent-back direction from a width direction end portion of the first contact portion, that has a surface at a distal end side thereof, the surface being curved to be opposite to the first contact portion, and that covers and holds the second contact portion in a state in which the first contact portion and the second contact portion are laid over each other.

9. The connector according to claim 1, further comprising a second member that is wound around the second and first contact portions and biases the first and second contact portions in directions approaching each other, in a state in which the first and second contact portions are laid over each other.

10. The connector according to claim 1, wherein a radius of an individual tooth tip of the first teeth portion is different from a radius of an individual tooth bottom of the second teeth portion.

11. The connector according to claim 10, wherein the radius of the individual tooth tip of the first teeth portion is larger than the radius of the individual tooth bottom of the second teeth portion.

* * * * *